US006655770B2

(12) United States Patent
Anderson et al.

(10) Patent No.: US 6,655,770 B2
(45) Date of Patent: Dec. 2, 2003

(54) APPARATUS AND METHOD FOR PRINTING WITH SHOWERHEAD GROUPS

(75) Inventors: Daryl E. Anderson, Corvallis, OR (US); Mark S. Hickman, Vancouver, WA (US); Michael J. Barbour, Corvallis, OR (US); George H. Corrigan, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 45 days.

(21) Appl. No.: 09/847,966

(22) Filed: May 2, 2001

(65) Prior Publication Data

US 2002/0163549 A1 Nov. 7, 2002

(51) Int. Cl.[7] ..... B41J 29/38
(52) U.S. Cl. ..... 347/12
(58) Field of Search ..... 347/12, 48, 181, 347/182

(56) References Cited

U.S. PATENT DOCUMENTS

| | | | | | |
|---|---|---|---|---|---|
| 5,072,237 | A | * | 12/1991 | Takaoka | 347/181 |
| 5,265,315 | A | * | 11/1993 | Hoisington et al. | 29/25.35 |
| 5,644,342 | A | | 7/1997 | Argyres | 347/12 |
| 6,017,112 | A | * | 1/2000 | Anderson et al. | 347/40 |
| 6,123,404 | A | * | 9/2000 | Tanaka et al. | 347/5 |
| 6,149,259 | A | * | 11/2000 | Otsuka et al. | 347/12 |
| 6,296,340 | B1 | * | 10/2001 | Tajika et al. | 347/12 |

* cited by examiner

*Primary Examiner*—Stephen D. Meier
*Assistant Examiner*—Alfred Dudding

(57) ABSTRACT

An ink jet printer (101) print head having multiple, redundant ink energizing elements arranged into clusters or groups (812), each of which attempts to expel ink onto media in a predetermined sequence. The effects of an ink energizing element failure are mitigated by using redundant elements, each of which fires in response to the same data.

13 Claims, 7 Drawing Sheets

APPARATUS AND METHOD FOR PRINTING WITH SHOWERHEAD GROUPS

FIELD OF THE INVENTION

The present invention relates to ink jet printers. In particular, the invention relates to an apparatus and method for ink jet printing using ink jets that are subdivided into groups.

BACKGROUND OF THE INVENTION

Ink jet printers are well known. A typical ink jet printer has a disposable ink cartridge containing an ink reservoir and a printhead. The printhead is fabricated from silicon and is formed to contain an array of thermally-actuated ink expulsion devices, also referred to herein as "ink energizing elements." The ink expulsion devices propel ink onto paper or other print media through small-diameter orifices referred to as "nozzles" by electrically heating a water-based ink to its vaporization temperature.

One problem with ink jet printer and the print heads used in them, (due to the small-diameter orifices through which ink is ejected) is the tendency of the print head orifices to clog from either dried ink or dirt. Another problem is electrical failure. A commonly-observed artifact of one or more clogged or malfunctioning print head elements (clogged orifices or inoperative electronics) is the striation of printed output, i.e., streaks of lighter color or white that appear across printed areas, which is caused by an inoperative print element. Because there is no practical way to unclog an orifice or repair an ink ejector, replacing the entire cartridge is the only way to cure printed output defects.

Ink cartridge replacement to correct streaked print output is not a cost effective way to maintain print output quality, especially when the ink cartridge retains useable ink. One way to mitigate the effect of an ink jet print head nozzle blockage is to fabricate the print head with redundant print elements. In such a device, the effects of a failure of one print element might be reduced if a redundant print element is able to compensate for the failed element.

A problem with redundant print elements is the speed at which print data must be clocked into them. It is well-known that as the number of print elements increases, print data must be clocked into them at correspondingly higher rates, if overall printer speed (typically measured in printed "pages per minute") is to be maintained. As print data clock rates into a print head increase, electromagnetic signals (noise) that such signals generate, and conversely are susceptible to, becomes problematic. Accordingly, there is a need for an apparatus and method that more efficiently addresses the problem of nozzle blockage and in particular, the need to rapidly "clock" print data into a print head having multiple redundant printing elements without generating electromagnetic interference.

SUMMARY OF THE INVENTION

Ink jet print head ink (or other fluid) energizing elements (including the circuitry used to pump electrical current through a heater resister as well as the heater resistor, a fluid chamber in the print head and orifices formed in the ink jet print head top plate) are logically arranged into ink jet clusters or groups. Print data from a host system is serially clocked into a shift register, the output bits of which are coupled to parallel-connected fluid expulsion elements that are individually controlled. The ink energizing elements of a group or cluster are fired sequentially using the same print data bit from the shift register so that each bit of print data is fired from multiple fluid expulsion elements, providing a redundant ink firing.

DETAILED DESCRIPTION OF A PREFERRED EMBODIMENT

Figure 1:
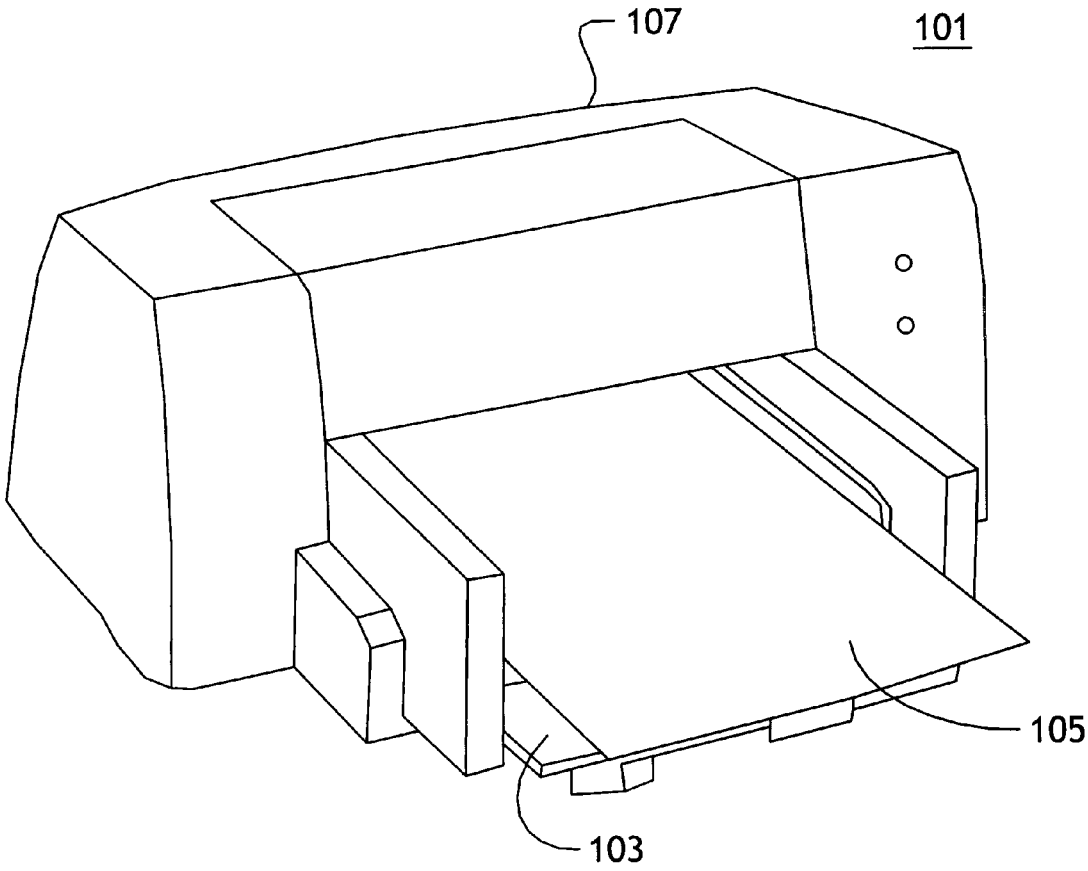
PRIOR ART Fig. 1
FIG. 1 depicts a perspective view of an ink jet printer.

The effects of ink ejecting element failure in a thermal ink jet printer, such as that shown in FIG. 1, is minimized by fabricating a print head that has redundant print elements. Print data from a host system that controls the placement of ink, is coupled to individually-controlled firing elements, arranged into related groups, the firing of individual members of which is independently controllable. The redundant print elements of a cluster are fired using the same print data so as to help insure that ink is deposited onto a print media in every instance that ink is supposed to be fired. "Print data" refers to data (logic zeroes and ones represented as voltage pulses) from a host system that controls the actual ejection of ink from the print head. The format and delivery of "print data" is beyond the scope of this disclosure and not necessary to an understanding of the invention disclosed herein.

It should be noted that while the invention disclosed and claimed herein contemplates usage with an ink jet printer, the invention can be used in any application requiring precision dispensing of fluids, including ink. For purposes of this disclosure, the description of the invention with respect to ink and ink jet print heads is for purposes of convenience, brevity and clarity only. The term "ink" should be considered to include other fluids beside ink, the physical characteristics of which (boiling point; viscosity; density, etc.) allow such other fluids to be used with the structures and methods described herein.

In FIG. 1, a prior art ink jet printer 101, such as those available from the Hewlett-Packard Company, communicates with a host computer system (not shown), which could be (for example) a computer or microprocessor that sends predetermined-format "print data" to the printer 101. The "print data" is embodied as electrical signals (typically binary-valued voltage pulses) to which the printer 101 is responsive so as to produce in response thereto, images such as pictures and/or text on a print media. The host system typically generates and formats the data in order to print characters or images on print media. Various printer control languages (e.g., HP PCL, Adobe Post Script®) that used to control printers are known in the art.

Printer 101 includes media input tray 103 that stores printable media 105, examples of which include paper, transparencies, and transfer sheets. Printer housing 107 shelters media-feeding device 201 (FIG. 2) that advances printable media 105 into printer 101 along the y-axis (as shown).

Figure 2:
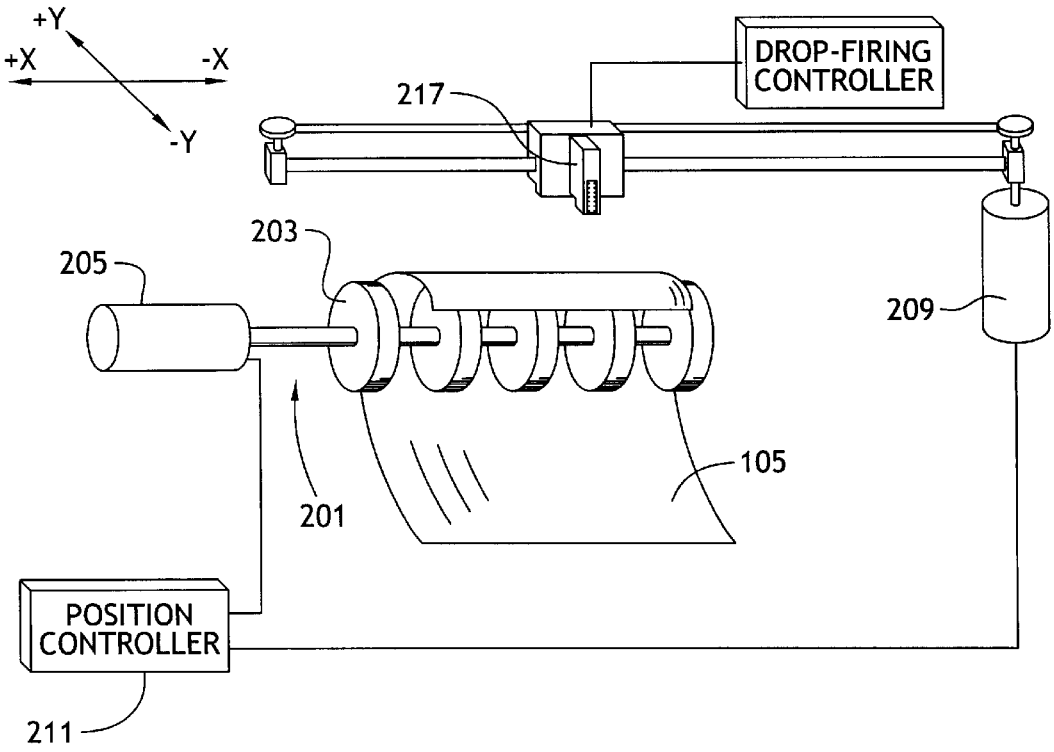
PRIOR ART Fig. 2
FIG. 2 depicts a representative in ink jet printer print mechanism.

FIG. 2 depicts a simplified schematic depiction of prior art printer parts within the printer housing 107 shown in FIG. 1. A media feeding device 201 comprised of rollers 203 are driven by platen motor 205, as well as traction devices which are not shown for clarity. The rollers 203 and platen motor 205 power the advancement of printable media 105 along the y-axis (as shown) into (or under) a print cartridge 217 that reciprocates across the print media 105 under the control of a carriage motor 209. The carriage motor 209 and the platen motor are controlled by a position controller 211, well known in the art. U.S. Pat. No. 5,070,410 to Hadley, which is herein incorporated by reference, describes an exemplary position controller 211.

Figure 3:
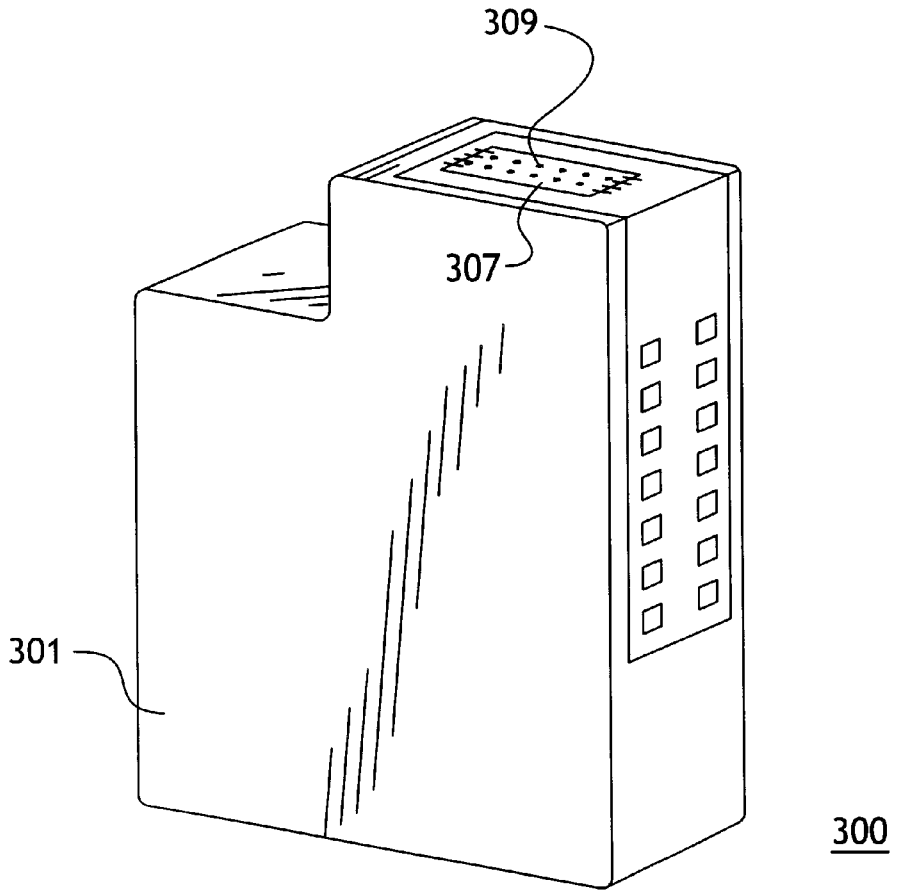
PRIOR ART Fig. 3
FIG. 3 depicts a perspective view of a fluid dispensing cartridge according to one embodiment of the present invention.

FIG. 3 depicts a perspective view of a prior art exemplary ink (or other fluid) dispensing cartridge 300 (identified in FIG. 2 reference numeral 217) used in ink jet printers, such as those available from the Hewlett-Packard Company as well as others. In FIG. 3, the ink dispensing cartridge 300 is shown "inverted" such that in operation in a printer, ink would flow out of the cartridge 300 through nozzles 309 onto print media. The fluid dispensing cartridge 300 includes a fluid reservoir 301, which holds ink or other fluid prior to expulsion through printhead 307.

The cartridge 300 includes a print head 307 comprised of a top plate (not shown in FIG. 3, but known in the art) having several, small-diameter nozzles or orifices 309 through which ink (or other fluid) can be ejected by being thermally energized (vaporized, i.e., boiled) by ink thermal energizing elements (described below with respect to the circuitry shown in FIG. 5) so that the ink (fluid) is expelled onto a print media. The ink energizing elements, which for claim construction purposes are considered to be comprised of the circuits shown in FIG. 5 and equivalents thereof, but also including the resistive elements (407 shown in FIG. 4) as well as the fluid chambers and orifices in the top plate, are all substantially on or part of the print head 307.

Figure 4:
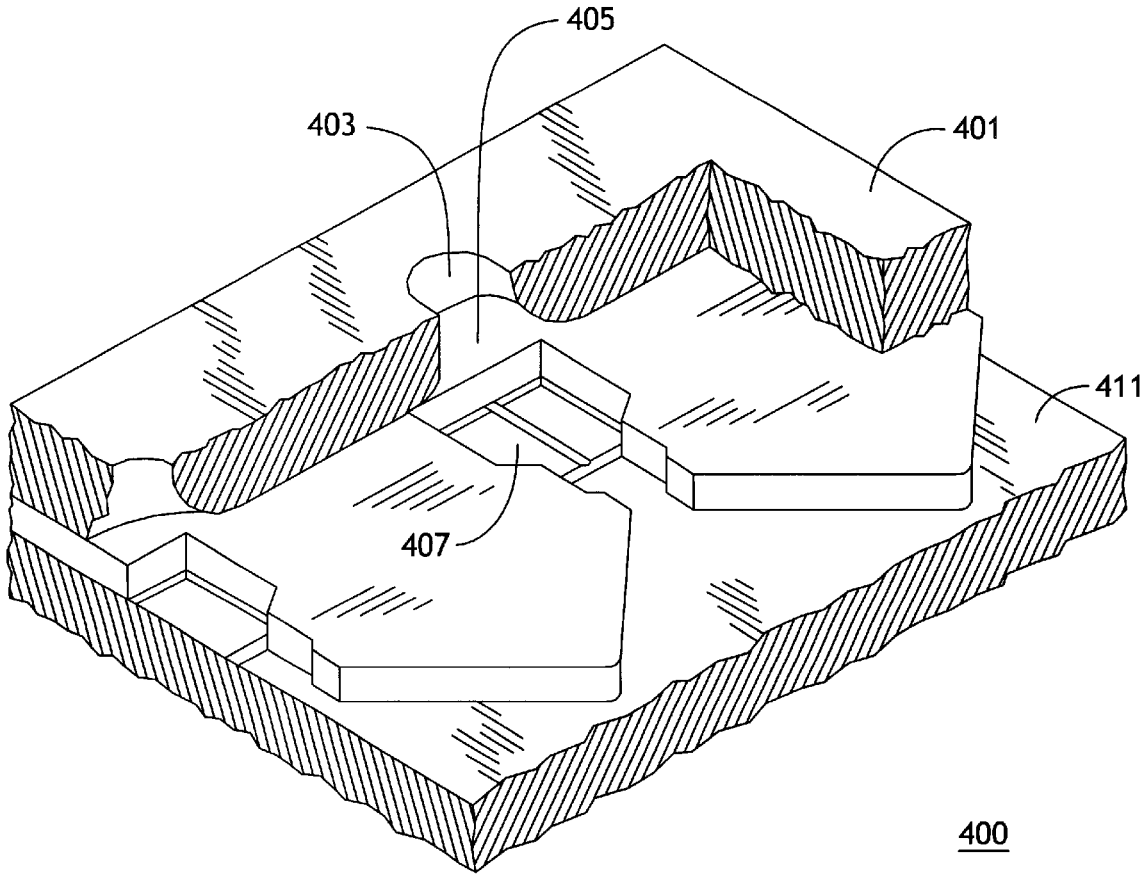
PRIOR ART Fig. 4
FIG. 4 depicts a perspective view of a portion of an ink energizing element that includes a fluid chamber, resistive element and part of a top plate and orifice.

FIG. 4 depicts a cutaway view of the exemplary structure of a single prior art thermal ink-energizing element 400 of a thermal ink jet print head used in a print cartridge such as the one shown in FIG. 3. A portion of a top plate 401 includes an orifice 403 through which vaporized ink (or other fluid) is expelled from a chamber 405 (formed in the print head) when ink (or other fluid) is vaporized by heat generated in a resistive element 407. Hundreds of such orifices can be found in high-resolution print heads. The ink-vaporization heat is generated in the resistive element 407 by electric current that flows through the resistive element 407 and which is controlled by circuitry (not shown) responsive to print data from a host system. The print data (not shown) that is sent to the print head determines which ink energizing elements in a print head should fire to produce an image on a print media. Not all of the ink energizing elements fire at the same time in order to lay down ink droplets on the print media. Ink from a reservoir (not shown in FIG. 4) flows into the chamber 405 and is retained in the chamber 405 by capillary action. An electric current through the resistive element 407 heats the fluid to vaporization whereupon the vaporized fluid is ejected through the orifice 403.

In an ink jet print head, numerous ink energizing elements 400 such as the portions of one depicted in FIG. 4, are arranged in columns and/or other patterns on the print head and individually fired under the control of either the printer controller or a host system, in order to controllably deposit ink onto media. The deposition of ink is according to the print data that sent to the print head electronics that controls the flow of current through the resistive element 407.

Because this invention provides a method and apparatus to print using redundant ink energizing elements, (which to be "redundant" must be provided with the same print data) the redundant ink energizing elements need to be provided with "copies" of the print data in order to insure that each of the redundant ink energizing elements will print the same data. In order to be able to timely fire redundant ink energizing elements in a print head when several such redundant elements need to be fired (either at the same time or within a relatively short time) the print data rate into the print head (which otherwise loads print data) is kept to a minimum (or reduced) when the print data from the host system for the redundant print elements is parallel-distributed or "fanned out" to redundant elements that are connected in parallel from a single source. When the print data is presented to parallel, (i.e. redundant) ink energizing elements, the actual firing of them is controlled to occur in a predetermined sequence by which each redundant firing element ejects (or does not eject) ink. When the physical capabilities of the print head so permit, the redundant print head elements can be fired simultaneously.

In the preferred embodiment, print data from a host system is serially clocked into a multi-bit shift register, the individual output bits of which are fanned out to several parallel-connected ink energizing elements referred to in the figures as "nozzle logic" circuits. The nozzle logic circuits coupled to a particular output bit of the shift register are "arranged" in groups and can be thought of, or considered to be, a "cluster," "group" or "shower head" of ink energizing elements for the particular output bit of the print data shift register. In the preferred embodiment shown in FIG. 5, each print data bit from a host system is clocked into two, multi-bit shift registers. Each output bit of each shift register is fanned out to two nozzle logic circuits so that a total of four nozzle logic circuits sequentially fire (or don't fire, depending upon the print data bit it is provided with) using the same print data. The four nozzle logic circuits that will fire (or cause the deposition of ink) onto a media are fired one-at-time in a sequence established by the outputs of a nozzle firing controller 520, which in the preferred embodiment is a four-bit ring counter. The preferred embodiment thus provides redundant ink energizing elements, each of which responds to the same print data bit from a host system. In the event that one or even more ink energizing elements fail, the other ink energizing elements still deposit ink, significantly reducing the likelihood of poor quality print. Alternate embodiments would include using virtually any number of functionally duplicative (redundant) ink energizing element.

Figure 5:
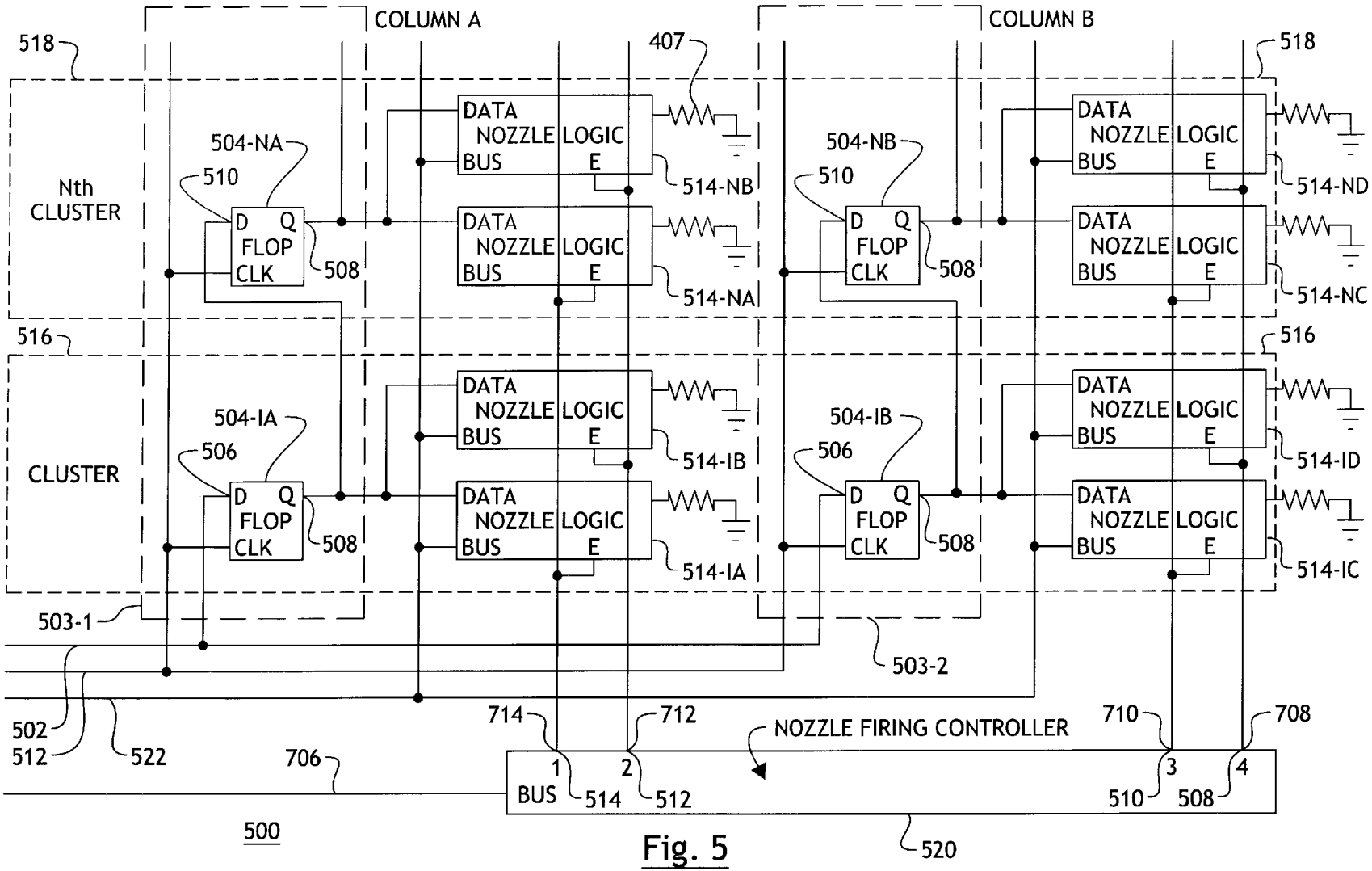
FIG. 5 depicts a schematic diagram of the ink energizing element control circuitry.

FIG. 5 depicts a schematic diagram of the logic circuitry of the preferred embodiment that is used to control several ink ejection elements that are logically grouped into clusters of redundant ink ejecting elements.

Serial print data from a host system is synchronously clocked into shift registers (503-1; 503-2) formed from "D" latches (504), the outputs of which are "fanned out" (connected in common) to two different ink-ejecting elements identified in the figure as "nozzle logic" circuits (514). The nozzle logic circuits respond to control signals input to them from a nozzle firing controller 520 that sequentially fires the nozzle logic circuits causing current to flow through resistive elements (See element 407 in FIGS. 4 and 5.) located in the print head substrate 411, which vaporizes ink to be ejected from the print head.

The nozzle logic circuits 514 used to control current through the resistive elements 407 are known in the art. In the preferred embodiment, the nozzle logic circuits 514 are implemented with series-connected field effect transistors (as used in the prior art) which are fabricated on the print head substrate. The resistive element 407 is coupled between Vcc and the "source" of one FET, the "drain" of which is coupled to the "source" of the second FET, the "drain" of which is coupled to ground or a reference potential. The "gate" terminals of the FETs are respectively used to "enable" and "fire" the FETs so as to control the flow of current through the resistive element 407 and in turn, cause ink to be ejected from the print head. Alternate embodiments of nozzle logic circuits would include using a single FET, one or more bipolar junction transistors, SCR's or other well-known semiconductor active devices to control voltage or current. In addition to FETs, bi-polar transistors and SCRs, current flow through the resistive elements 407 could also be controlled using latches or logic gates, provided that they have sufficient current-carrying capacity for the purpose of electrically heating the ink in a short time.

The ink ejecting elements ("nozzle logic" circuits) are fired in a sequence determined by a nozzle firing controller 520 so as to redundantly eject ink by repeatedly firing ink ejecting elements with the same data. If one nozzle logic circuit (in a cluster of such circuits) of FIG. 5 fails, or if one resistive element 407 (See FIG. 4.) on the output of one of the nozzle logic circuits 514 fails, or if an orifice in a top plate is obstructed (See FIG. 4.), the other, i.e., redundant, ink ejecting elements in the cluster of such elements will (presumably) continue to operate to propel ink from the print head, thereby maintaining a higher print head reliability and print output quality than would otherwise be possible.

In FIG. 5, serial print data from a host system (not shown) on the input line 502, originates from a host system or the printer controller (not shown) and is synchronously shifted into "D"-type data latches 504-1–504-N which are coupled together so as to function as a shift register, two of which are shown in FIG. 5 and that are identified by reference numerals 503-1 and 503-2 respectively. (FIG. 7 shows an exemplary timing diagram of the signals in the circuitry shown in FIG. 5)

Figure 7:
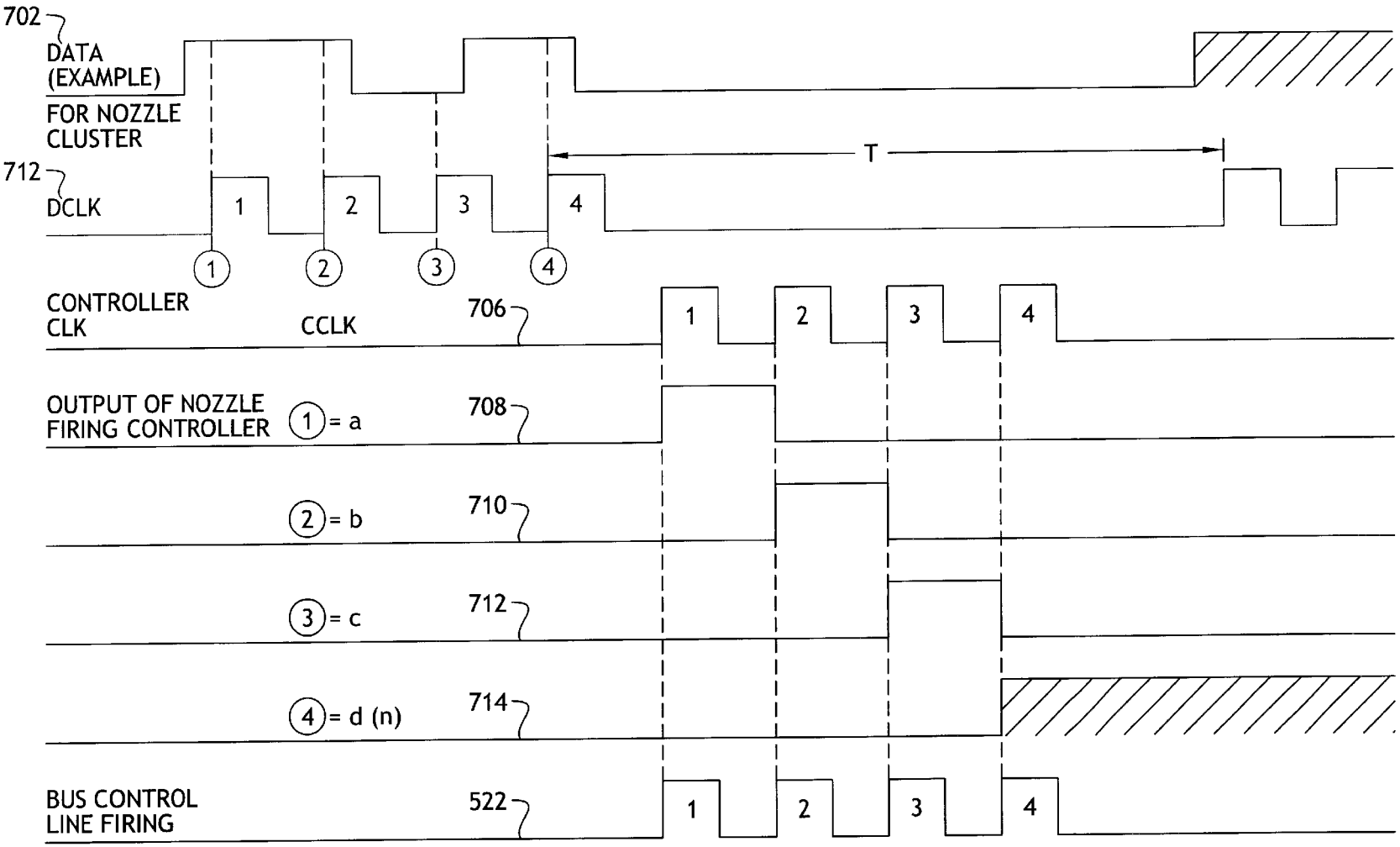
FIG. 7 depicts an exemplary timing diagram.

With respect to this disclosure, and in particular FIGS. 5 and 7, the meaning of term "line" should be construed to include electrically conductive pathways such as those commonly found in, and on, semiconductor substrates, circuit board, wires, cables, contact nodes, any of which carry electrical representations of information between two or more points. The term should also be construed to include wireless signals, including infrared and radio frequency signals, which can also carry electrical representations of information between to points.

Alternate (and equivalent for claim construction purposes) embodiments of the invention would include using an N-bit processor data bus or control bus to transfer data into the latches 504. The parallel lines of a processor bus could be coupled to the "D" input of each latch whereupon data on the bus would be synchronously clocked into the latches in one clock pulse interval.

Those skilled in the art will recognize that as shown in FIG. 5, a shift register can be realized with "D"-type latches if the "Q" outputs of a first latch is coupled to the "D" input of a successive latch. In FIG. 5, the "D" input 506 of a first latch 504-1A of a first shift register 503-1 receives serial data on line 502 that originates from a host system. At the same, the data on line 502 is input to the "D"input 506 of another latch 504-1B of a second shift register 501-2. Upon the occurrence of a clock pulse on the DCLK line 512, the data on the "D" inputs is latched and appears at the "Q" outputs 508 of both latches 504-1A and 504-1B. Signal on the "Q" outputs 508 of latch 504-1A and 504-1B are coupled to the "D"inputs 510 of the N'th latches 504-NA and 504-NB. Alternate embodiments of the invention (and equivalents for claim construction purposes) would include using J-K and S-R flip flops and logic gate equivalents as well as semiconductor random access memory (RAM) devices into which data could be written and subsequently read from.

In the embodiment shown in FIG. 5 data on the line 502 is synchronously loaded into two, multi-bit shift registers 503-1 and 503-2. In an ink jet print head, wherein an ink slot through the substrate feeds ink chambers on opposing sides of the slot, using two shift registers as shown in FIG. 5 allows for redundant ink energizing elements on both sides of the slot. Alternate embodiments would of course include using only one shift register or using more than two, depending upon the topology of the print head as those skilled in the art will recognize. It can also be seen that the a"Q" output bits of each latch of each shift register is fanned out to at least two nozzle controller circuits. Redundant ink jet firing (and therefore, improved output print quality) is accomplished by firing each of the nozzle controller circuits to which an output bit of a shift register 503-1 and 503-2 is coupled, using print data loaded into the shift registers 503-1 and 503-2.

By way of example, if "N" is equal to eight (corresponding to an eight-bit print data shift register), eight DCLK pulses on line 512 are required to shift a "first" bit of print data from the "Q" output 508 of latch 504-1 to the "Q" output 508 latch 501-8. (Only two latches are shown in FIG. 5 for clarity.) Once all eight bits of print data is clocked into the shift registers, 503-1 and 503-2, the eight outputs of each bit position of each shift register is fanned out to two (2), individually-controllable parallel-connected nozzle logic firing circuits.

In FIG. 5, the "Q" outputs 508 of "D" latches 504-1A-504-NA of the shift register 503-1 are each fanned out to two nozzle logic control circuits. In particular, the Q output 508 of latch 504-1A is fanned out to nozzle logic control circuits 514-1A and 514-1B. Similarly, the Q output of latch 504-NA is fanned out to nozzle logic control circuits 514-NA and 514-NB. The Q output 508 of latch 504-1B is fanned out to nozzle logic control circuits 514-1C and 514-1D.

In FIG. 5, if print data (which is data from a host system that controls the deposition of ink onto a media from the print head) is sent to the print head, N-bits at a time, N such bits (thereby comprising a "print data word") can be clocked into the two shift registers 503-1 and 503-2 using only N, clock pulses on the DCLK line 512. Using only N clock pulses, each logic 1 (or "true" or "active") data bit of a print data word causes ink to be ejected from each of the nozzle logic controllers to which a print data bit is being sent. Because it is the data bits of the print data word stored in the shift registers 503-1 and 503-2, fanning out the bits of the shift registers allows the shift registers (that are loaded at a relatively low clock speed) to repeatedly fire redundant nozzle logic circuits 514-1A–1D and 514-NA–ND without having to either reload the shift register or to use a much larger shift register that would need to be clocked at a much higher data rate.

The functional relation of the nozzle control logic circuits 514-1A–D to each other and the relation of the nozzle control logic circuits 514-NA–514-ND to each other suggests that such grouping or clustering of nozzle circuits be considered to be a relation to each other. Accordingly, the nozzle logic circuits grouped together (514-1A–D as one group; 514-NA–ND as a second group) are referred to herein as nozzle clusters or nozzle groups. The nozzle logic circuits that are logically grouped together to form clusters effectively provides for several different ink pulses to be deposited onto a media. Firing the nozzle logic control circuits of the nozzle clusters at least once, for each print data word saved into the print head shift registers 503-1 and 503-2 is accomplished using a nozzle firing controller 520 that functions as a ring counter, the details of an exemplary embodiment of which is depicted in FIG. 6.

Figure 6:
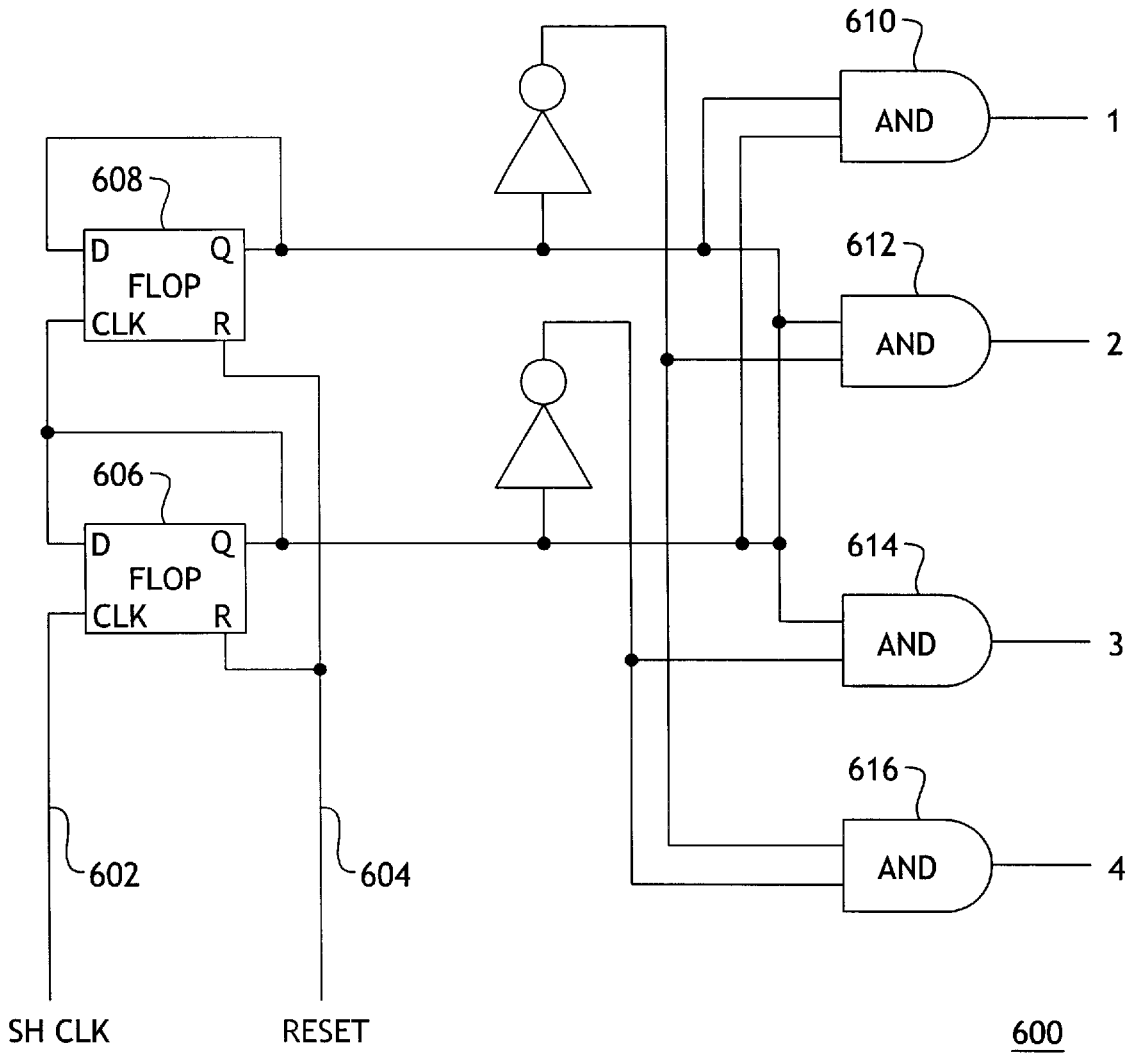
FIG. 6 depicts an exemplary ring counter.

FIG. 6 depicts a simple, four-bit ring counter 600. One of four outputs 610, 612, 614 and 616 is at a logic "one" or "true" for the duration of a clock pulse input signal on clock input line 602. As successive clock pulses are received on the clock input line 602, one of the four outputs 610, 612, 614 and 616 successively change state from a logic zero to a logic one, in a ring-like rotation of a logic one through each output.

It can be seen in FIG. 6 that multiple lines are coupled into the ring counter. Signals that clear or reset the ring counter are provided as well as signals that cause the counter to increment. Those skilled in the art will recognize that the term "bus" is used to refer to sets of conductors or "lines" that are related to each other, such as "address bus" line and "data bus" lines over which address information and data are carried respectively.

FIG. 7 depicts a timing diagram 700 of the inputs and output of a system with four clusters, each of which has four-bit nozzles having the topology shown in FIG. 5. Accordingly, the discussion of the signals shown in FIG. 7 is with respect to the circuit shown in FIG. 5. (The 700-series reference numerals appearing in FIG. 5 therefore refer to correspondingly identified waveforms in FIG. 7.) In FIG. 7, the DATA line 702, corresponds to the DATA line 502 of FIG. 5. The DCLK line 712 in FIG. 7 corresponds to line 512 in FIG. 5. The CONTROLLER CLK line 706 of FIG. 7 corresponds to the line with the same reference numeral (706) shown in FIG. 5.

At clock pulse 1 on the DCLK line 712 (line 512 in FIG. 5), DATA line 702 (line 502 in FIG. 5) is at logic "1." Clock pulse 1 triggers the logic "1" value on the DATA line 702 to be latched; the "Q" outputs of latches 504-1A and 504-1B (in FIG. 5) therefore go to logic "1". (The "Q" outputs of the latches are not shown in FIG. 7 for clarity. A person of ordinary skill in the art understands the operation of the logic circuitry shown in FIG. 5.)

It can be seen from the topology of the circuit depicted in FIG. 5 that the "Q"outputs of latches 504-1A and 504-1B (in FIG. 5) are coupled to the "D" inputs of latches 504-NA and 504-NB. It can also be seen that the CLK inputs of all the latches are coupled together in parallel such that all of the latches are synchronously clocked. Therefore, at clock pulse 2 on the DCLK line 712 (line 512 in FIG. 5), DATA on line 702 (line 502 in FIG. 5) remains at logic "1." Clock pulse 2 caused the logic "1" on the "Q" outputs of 504-1A and 504-1B to be latched into latches 504-NA and 504-NB, thereby causing the "Q" outputs of latches 504-NA and 504-NB (in FIG. 5) to go to logic "1." At clock pulse 2, the logic "1" the DATA line 702 remains at logic "1" which is latched into 504-1A and 504-1B such that the "Q" outputs of latches 504-1A and 504-1B (in FIG. 5) remain at logic "1". At clock pulse 2, the outputs of latches 504-NA and 504-1A are "1-1" respectively.

At clock pulse 3 on the DCLK line 712 (line 512 in FIG. 5), DATA on line 702 (line 502 in FIG. 5) is at logic "0." Clock pulse 3 triggers the logic "1" that was on the "Q" outputs of 504-1A and 504-1B to be latched into latches 504-NA and 504-NB, thereby causing the "Q" outputs of latches 504-NA and 504-NB (in FIG. 5) to remain at logic "1." At clock pulse 3, however, the logic "0" that was on the DATA line 702 (line 502 in FIG. 5) is latched into 504-1A and 504-1B such that the "Q" outputs of latches 504-1A and 504-1B (in FIG. 5) go to logic "0" from logic "1". At clock pulse 3, the outputs of the "Q" outputs of latches in a four-nozzle configuration would contain binary values of 1-1-0.

At clock pulse 4 on the DCLK line 712 (line 512 in FIG. 5), DATA on line 702 (line 502 in FIG. 5) is at logic "1." Clock pulse 4 triggers the logic "0" that was on the "Q" outputs of 504-1A and 504-1B to be latched into latches 504-NA and 504-NB, thereby causing the "Q" outputs of latches 504-NA and 504-NB (in FIG. 5) to changes state to a logic "0." At clock pulse 4, the logic "1" on the DATA line 702 (line 502 in FIG. 5) is latched into 504-1A and 504-1B such that the "Q" outputs of latches 504-1A and 504-1B (in FIG. 5) go to logic "0" from logic "1". In a four-bit showerhead, the data latches carry the bit pattern: 1101 after clock pulses 1, 2, 3 and 4 occur.

As set forth above, the data latched into the data latches 510-1A–510 NB is fanned out to multiple nozzle logic circuits 514-1A–514-ND. Each "D" latch has its output coupled to two or more nozzle logic circuits. Firing the redundant nozzle logic circuits in sequence using the same data (at the output of the "D" latch to which a cluster or group of nozzle logic circuits is coupled) is accomplished in the preferred embodiment using a ring counter for the nozzle firing controller 520.

It can be seen in FIG. 7 that the clock pulses 1–4 on the DCLK line 712 are followed by a quiescent period of inactivity, T during which no pulses occur. During the interval T, the CCLK line 706 receives four pulses 1–4, which are coupled into the nozzle firing controller 520 as shown in FIG. 5. Inasmuch as the nozzle firing controller (or a functional equivalent thereof) operates as a ring counter, the outputs of the nozzle controller 708, 710, 712 and 714 each go to logic "1" in sequence and as represented in FIG. 7 by the waveforms on the lines identified by reference numerals 708, 710, 712 and 714. Those skilled in the art will recognize that the quiescent interval T can eliminated by additional data storage. Print data storage circuitry between the shift register and the nozzle logic circuits that stores print data can temporarily latch pending print data while the nozzle logic circuits await firing. Data rates into the shift register and clock rates to the nozzle logic circuits would require appropriate timing adjustment. For purposes of claim construction, such an alternate embodiment is considered to be equivalent to the structure disclosed and claimed herein.

The nozzle logic circuits 514-1A–514-ND are configured such that they energize a heater resistor when a bus control firing line 522 is logic "1" and the enable "E" input to the corresponding nozzle logic circuit is also at a logic "1". Accordingly, FIG. 7 shows a pulse train on line 522 the leading edges of which correspond to the leading edges of the outputs of the ring counter on lines 708, 710, 712 and 714. When the bus control firing line is logic "1" and the ring counter output line is logic "1" the nozzle logic circuit to which both signals are sent causes the nozzle logic circuit to activate, causing ink to be ejected.

While the preferred embodiment employed a ring counter to cycle the firing of nozzle logic circuits, other embodiments could use a variety of devices and techniques to sequentially fire the nozzle logic circuits. Such alternate embodiments would include, but not be limited to, a random access memory, a modulo-N counter, an FPGA, ASIC of the control or data bits on a processor's bus by which the controlled sequencing of the nozzle logic circuit firing is accomplished.

Those of ordinary skill in the art will also appreciate that the polarity of the various control lines and signal lines are also a design choice, determined by the particular logic circuitry chosen for the various functional elements.

By use of the foregoing method and apparatus, if a print data word (which determines what ink jet nozzles are to fire in the course of printing) from a host system is clocked into the shift registers 503-1 and 503-2, each bit of each print data word that is stored in the shift register can cause multiple droplets of ink to be ejected without having to reload other print data into the shift register. By fanning out the print data stored in the shift registers, to multiple nozzle controlling devices, an ink jet print head having with redundant nozzles can be controlled at a nominal data rate, i.e. without having to increase input print data rates so as to individually load the redundant ink energizing elements from the host system.

We claim:

1. A printhead comprising:

a substrate having a first and second groups of ink firing chambers;

an N-bit print data register having a serial input and N data outputs;

a first group of N ink energizing elements, each element having:

a print data input coupled to a corresponding one of said N data outputs, a first control input; and a resistive element in thermal contact with fluid in a corresponding ink firing chamber;

a second group of N ink energizing elements redundant of the first group of N ink energizing elements, each element having:

a print data input coupled to a corresponding one of said N data outputs and redundant of a corresponding one or said print data inputs of the first group, a second control input; and a resistive element in thermal contact with fluid in a corresponding ink firing chamber; and a nozzle firing controller having a first output coupled to said first control inputs and a second output coupled to said second control inputs wherein the nozzle firing controller first enables activation of the resistive elements in the first group of N ink energizing elements and then sequentially enables activation of the resistive elements in the second group of N ink energizing elements for redundant printing of each bit of print data in an N-bit print data input.

2. The print head of claim 1 wherein the nozzle firing controller is any one of a group comprising: a ring counter, a processor, an FGPA, a ROM, an ASIC, and a shift register device.

3. The print head of claim 1 wherein said N-bit data register is a shift register.

4. The print head of claim 3 wherein the shift register has at least one data input and a plurality of data outputs, and wherein each data output couples to at least one nozzle logic circuit.

5. The print head of claim 1, wherein the ink energizing element is any one of a group comprising: D flip-flop, an S/R flip flop, a J/K flip flop, and a latch.

6. The print head of claim 1 wherein said ink energizing element is comprised of at least one of a FET; a bipolar transistor; and an SCR.

7. The print head of claim 1 wherein said ink energizing element is comprised of a nozzle logic control circuit.

8. The print head of claim 7 wherein said nozzle logic control circuit is comprised of at least one of; a PET; a bipolar transistor; an SCR; a data latch; and a logic gate.

9. A printer having the print head of claim 1.

10. A method comprising the steps of:

transferring N-bit print data to at least one group of N data latches, each latch having an output coupled to the inputs of a plurality of redundant ink energizing elements that are arranged into N clusters, each ink energizing element having a nozzle logic circuit controlling the ejection of ink;

transferring each bit of said N-bit print data from each of said N data latches to said plurality of redundant ink energizing elements such that each ink energizing element in each of said N clusters receives a redundant bit of print data; and sequentially enabling each of the nozzle logic circuits in each cluster with signals from a nozzle controller such that the redundant ink energizing elements in each cluster sequentially eject ink corresponding to said redundant bit of print data.

11. The method of claim 10 wherein said step of transferring N-bit print data to N data latches is comprised of the step of serially clocking data into a shift register.

12. The method of claim 10 wherein there are multiple groups of N data latches.

13. The method of claim 12 wherein the multiple groups of N data latches are configured parallel to one another.

* * * * *

UNITED STATES PATENT AND TRADEMARK OFFICE

CERTIFICATE OF CORRECTION

PATENT NO. : 6,655,770 B2
DATED : December 2, 2003
INVENTOR(S) : Anderson et al.

It is certified that error appears in the above-identified patent and that said Letters Patent is hereby corrected as shown below:

Column 10,
Line 24, delete “PET;” and insert therefor -- FET; --.

Signed and Sealed this

Twenty-ninth Day of June, 2004

JON W. DUDAS
*Acting Director of the United States Patent and Trademark Office*